US005936548A

United States Patent [19]

Takatsuka

[11] Patent Number: 5,936,548

[45] Date of Patent: Aug. 10, 1999

[54] RADIO PAGING RECEIVER CAPABLE OF READILY CONFIRMING A STATE OF A NON READ MESSAGE

[75] Inventor: Kunihiro Takatsuka, Shizuoka, Japan

[73] Assignee: NEC Corporation, Tokyo, Japan

[21] Appl. No.: 08/928,539

[22] Filed: Sep. 12, 1997

[30] Foreign Application Priority Data

Sep. 13, 1996 [JP] Japan ..... 8-243654

[51] Int. Cl.[6] ..... G08B 5/22

[52] U.S. Cl. ..... 340/825.44; 455/426; 455/458; 340/825.46; 340/825.52

[58] Field of Search ..... 340/825.44, 825.22, 340/825.52, 825.47, 825.48, 825.49, 825.5; 455/38.1, 38.4, 38.5, 38.2, 11.1, 13.1, 567, 426, 427, 458, 417; 379/211

[56] References Cited

U.S. PATENT DOCUMENTS

| | | | |
|---|---|---|---|
| 5,075,684 | 12/1991 | DeLuca | 340/825.44 |
| 5,258,751 | 11/1993 | DeLuca et al. | 340/825.44 |
| 5,418,528 | 5/1995 | Hosack et al. | 340/825.44 |

FOREIGN PATENT DOCUMENTS

| | | |
|---|---|---|
| 1-288120 | 11/1989 | Japan . |
| 3-16750 | 2/1991 | Japan . |
| 6-77880 | 3/1994 | Japan . |
| 8-191468 | 7/1996 | Japan . |
| WO 93/09520 | 5/1993 | WIPO . |
| WO 95/06921 | 3/1995 | WIPO . |

*Primary Examiner*—Michael Horabik
*Assistant Examiner*—Jean B. Jeanglaude
*Attorney, Agent, or Firm*—Scully, Scott, Murphy & Presser

[57] ABSTRACT

In a radio paging receiver for being responsive to a radio signal carrying a message and an attribute of the message, a memory circuit (61) has a plurality of directories, a selected one of which is assigned to the attribute. The message is stored as a memorized message into the selected directory with reference to the attribute. In this event, a control section (20) gives a particular flag to the memorized message that is not read by a processor of the receiver. The processor can display the memorized message on an display unit (52) with operation of an operating section (40). When the memorized message is displayed on the display unit, the control section erases the particular flag from the memorized message. It is possible to make the display unit display information relating to the memorized message that is not given with said particular flag.

10 Claims, 5 Drawing Sheets

| DIRECTORY | PRESENCE OF NON-READ MESSAGE |
|---|---|
| A | ○ |
| B | × |
| C | ○ |
| D | ○ |
| E | ○ |

FIG. 5A

| DIRECTORY | TOTAL MESSAGE NUMBER | PRESENCE OF NON-READ MESSAGE |
|---|---|---|
| A | 4 | ○ |
| B | 1 | × |
| C | 3 | ○ |
| D | 4 | ○ |
| E | 5 | ○ |

FIG. 5B

| DIRECTORY | TOTAL MESSAGE NUMBER | NON-READ MESSAGE NUMBER |
|---|---|---|
| A | 4 | 1 |
| B | 1 | 0 |
| C | 3 | 2 |
| D | 4 | 3 |
| E | 5 | 1 |

FIG. 5C

| PORTION OF MESSAGE | DATE AND TIME | NON-READ | OTHER ATTRIBUTE |
|---|---|---|---|
| AAAAAAAA | 03-16-10-66 | ○ | Taro YAMADA |
| BBBBBBBB | 03-15-22-01 | | |
| CCCCCCCC | 03-15-20-18 | | Taro YAMADA |
| DDDDDDDD | 03-14-15-00 | | Toshihiko MURAMATSU |

FIG. 6

RADIO PAGING RECEIVER CAPABLE OF READILY CONFIRMING A STATE OF A NON READ MESSAGE

BACKGROUND OF THE INVENTION

The present invention relates to a radio paging receiver having a message display function.

There have been available various radio paging receivers having a message display function of storing a received message in a memory and displaying the received message on a display unit depending on an operation by a user. Recently, as new services using radio waves, information services about, for example, weather forecast and news have been offered for the radio paging receivers and the like.

Under these circumstances, demands for further advanced functions of the radio paging receivers have been increased. Specifically, it is not sufficient only to perform readout and display of a received message in response to a command from a user, but such a function has been demanded that received messages are managed so as to quickly offer a received message/messages corresponding to an attribute, for example, a sender or an identification number (ID) desired by the user.

As a conventional technique proposed for satisfying such a demand, a radio paging receiver disclosed in Japanese Unexamined Patent Publication No. 1-288120 can be cited. The disclosed radio paging receiver has a plurality of paging numbers (ID's) and is capable of receiving a call using any of these ID's. In this radio paging receiver, a received message and a corresponding ID are stored in a memory in a pair. In response to a given operation by the user, the radio paging receiver carries out readout and display of received messages in sequence from new to old per ID or relative to all the ID's.

In general, a message received by a radio paging receiver is not immediately read out, but stored in a memory without confirmation by a user, while it may happen that the user confirms the received message at once upon receipt. For example, in general, the radio paging receiver can be set so as not to notify receipt of a message to the user. In this case, even if the message is received, the user does not notice it. For solving such an inconvenience, the radio paging receiver is provided with a function of notifying presence of a non-read message whose contents are not confirmed by the user and performing readout and display of such a non-read message depending on an operation by the user.

However, the conventional radio paging receiver only displays all the non-read messages in sequence from new to old, and does not display a remaining state of the non-read messages per attribute (for example, ID). Thus, it is quite inconvenient for the user to confirm the non-read message remaining state of a desired attribute. Further, it sometimes happens that, when a plurality of non-read messages belonging to the same attribute are stored in a memory, the user may wish to read them successively. However, since the conventional radio paging receiver is not provided with such a function, the user can not quickly confirm the non-read messages belonging to a particular attribute which the user wishes to check.

SUMMARY OF THE INVENTION

It is therefore an object of the present invention to provide a radio paging receiver which is capable of easily confirming a remaining state of a non-read message per attribute.

It is another object of the present invention to provide a radio paging receiver which is capable of easily confirming the contents of a non-read message per attribute.

Other objects of this invention will become clear as the description proceeds.

According to an aspect of the present invention, there is provided a radio paging receiver for being responsive to a radio signal carrying a message and an attribute of the message. The radio paging receiver comprises a display unit, command producing means for producing a plurality of command signals, and zeroth displaying means for displaying the message on the display unit in response to a zeroth one of the command signals. The radio paging receiver further comprises a plurality of directories, a selected one of which is assigned to the attribute, storing means connected to the zeroth displaying means and the directories for storing the message as a memorized message into the selected one of the directories with reference to the attribute, the storing means giving a particular flag to the memorized message only when the zeroth displaying means is not operated, first displaying means connected to the display unit, the command producing means, and the directories for displaying the memorized message on the display unit in response to a first one of the command signals, erasing means connected to the directories and the first displaying means for erasing the particular flag from the memorized message when first displaying means is operated, and second displaying means connected to the display unit, the command producing means, and the directories and responsive to a second one of the command signals for displaying, on the display unit, information relating to the memorized message that is not given with the particular flag.

According to another aspect of the present invention, there is provided a radio paging receiver comprising a memory, a display unit, a receiving section, an operating section for inputting a command, and a control section, wherein the control section identifies an attribute of each of messages when received at the receiving section, and stores each of the messages along with a non-read flag in a directory in the memory, the directory predetermined corresponding to each of the attributes, wherein, when one of the messages is read out from the memory and displayed by the display unit according to a command from the operating section, the control section erases the non-read flag corresponding to the displayed message, and wherein, according to a command from the operating section, the control section controls the display unit to display, per directory, a remaining state of each of the messages which are stored in the directories and whose non-read flags are not erased.

According to the present invention, there is provided a method of being responsive to a radio signal carrying a message and an attribute of the message. The method comprises the steps of producing a plurality of command signals and displaying the message on a display unit in response to a zeroth one of the command signals. The method further comprises the steps of a plurality of directories, a selected one of which is assigned to the attribute, storing the message as a memorized message into a selected one of a plurality of directories with reference to the attribute, giving a particular flag to the memorized message in response to absence of the zeroth one of the command signals, displaying the memorized message on the display unit in response to a first one of the command signals, erasing the particular flag from the memorized message in response to presence of the first one of the command signals, and being responsive to a second one of the command signals and displaying, on the display unit, information relating to the memorized message that is not given with the particular flag.

BRIEF DESCRIPTION OF THE DRAWINGS

FIGS. 5A through 5C are diagrams, respectively, showing examples of display carried out by a display unit of FIG. 1; and FIG. 6 is a diagram showing an example of display carried out by the display unit of FIG. 1.

DESCRIPTION OF THE PREFERRED EMBODIMENT

Figure 1:
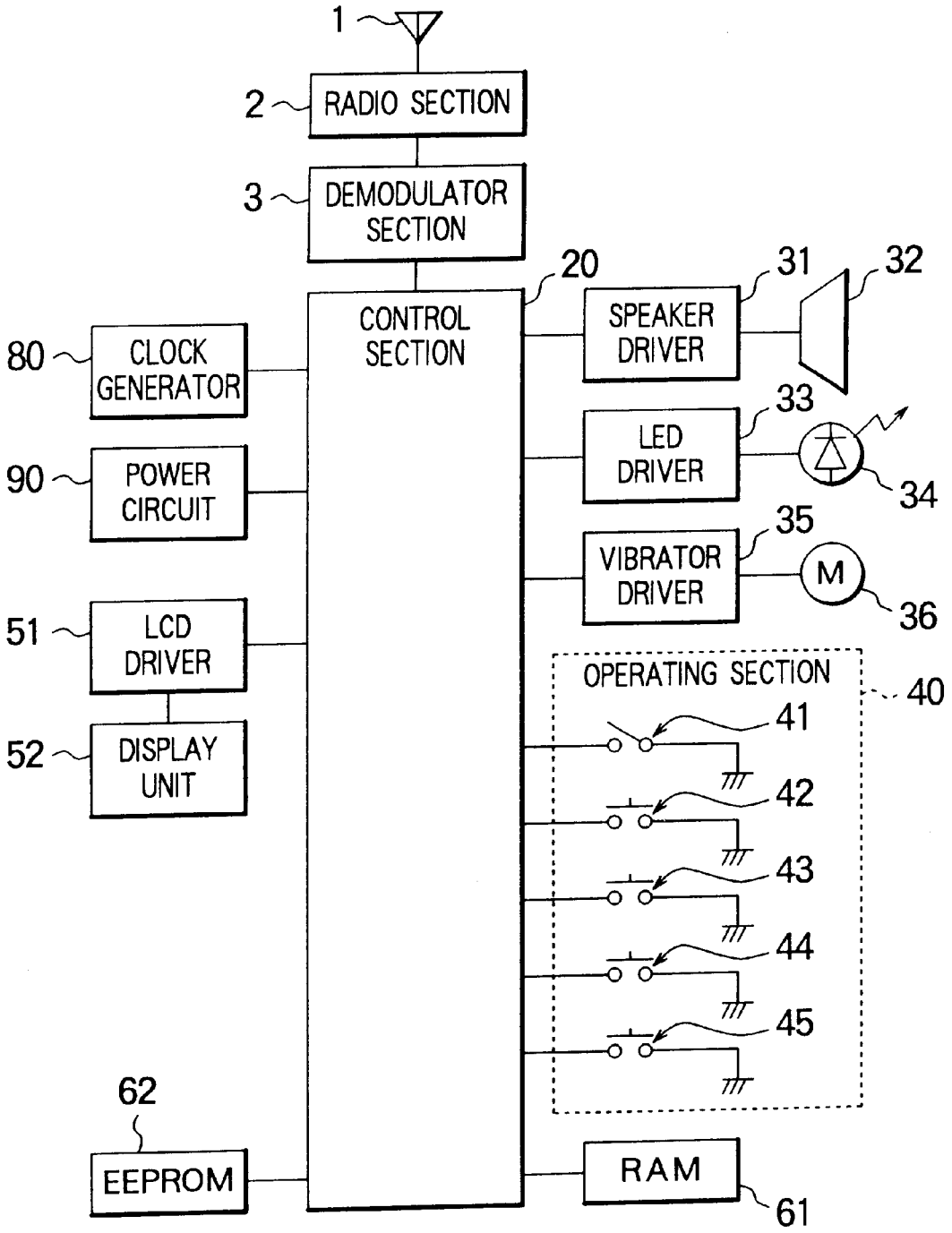
FIG. 1 is a block diagram showing a structure of a radio paging receiver according to a preferred embodiment of the present invention.

Referring to FIG. 1 at first, description will be made as regards a structure of a radio paging receiver according to an embodiment of the present invention. The radio paging receiver is included in a paging system known in the art and is for receiving a radio call signal from a base station (not shown) of the paging system at an antenna 1. The radio call signal is a radio frequency signal using, as a modulating signal, a digital signal carrying a call number (ID) of the radio paging receiver, a message and so forth.

The radio call signal is amplified at a radio section 2 and subjected to demodulation and waveform shaping at a demodulator section 3 so as to be a digital signal readable at a control section 20 which controls the whole radio paging receiver. A combination of the antenna 1, the radio section 2, and the demodulator section 3 is referred to as a receiving section.

The control section 20, using a notification control means (not shown) included therein, extracts the ID and information about the message and so forth from the foregoing digital signal and compares the ID with one or more addresses of the subject radio paging receiver which are prestored in a writable read-only memory (EEPROM) 62. If agreed with each other, a notification of presence of a call is carried out as a call notification.

Specifically, upon the call notification, the notification control means of the control section 20 drives a speaker driver or a drive amplifier circuit 31, an LED driver 33, a vibrator driver 35 and an LCD driver 51, and controls sounding by a speaker 32, emission by a light emitting diode (LED) 34, vibration by a vibrator motor 36 and display by a display unit 52 of a liquid crystal display known in the art.

Simultaneously, the control section 20, using a message readout means (not shown) included therein, stores the information about the message and so forth extracted by the notification control means into a memory circuit (RAM) 61 preferably in the form of a random-access memory known in the art. The RAM 61 has a plurality of directories in the manner known in the art.

After this storage operation, the control section 20, using the message readout means, drives the LCD driver 51 to display the information now stored in the RAM 61 on the display unit 52.

The radio paging receiver further includes a clock generator 80 which generates timing clocks for controlling operations of various sections in the receiver, a power circuit 90 for feeding the power to various sections in the receiver, and an operating section 40.

The operating section 40 is for producing a plurality of command signals and is referred to as a command producing arrangement. The operating section 40 includes a power switch 41 for switching on and off the power feed by the power circuit 90, a readout switch 42 for commanding readout of the information stored in the RAM 61, a scroll switch 43 for scrolling the displayed information on the display unit 52 or commanding selection thereof, a reset switch 44 for commanding to erase the information stored in the RAM 61, stop operations of the speaker 32 and others or shift to a menu mode, and an execution switch 45 for determining a menu or other operations.

This preferred embodiment of the present invention is characterized by a function of, when one or more non-read messages (whose receipts are not confirmed by the user or whose contents are not confirmed by the user) exist, selecting the non-read message/messages depending on the precedence determined by the user and directly shifting to a selected one of the directories managing and storing the selected message/messages.

Figure 2:
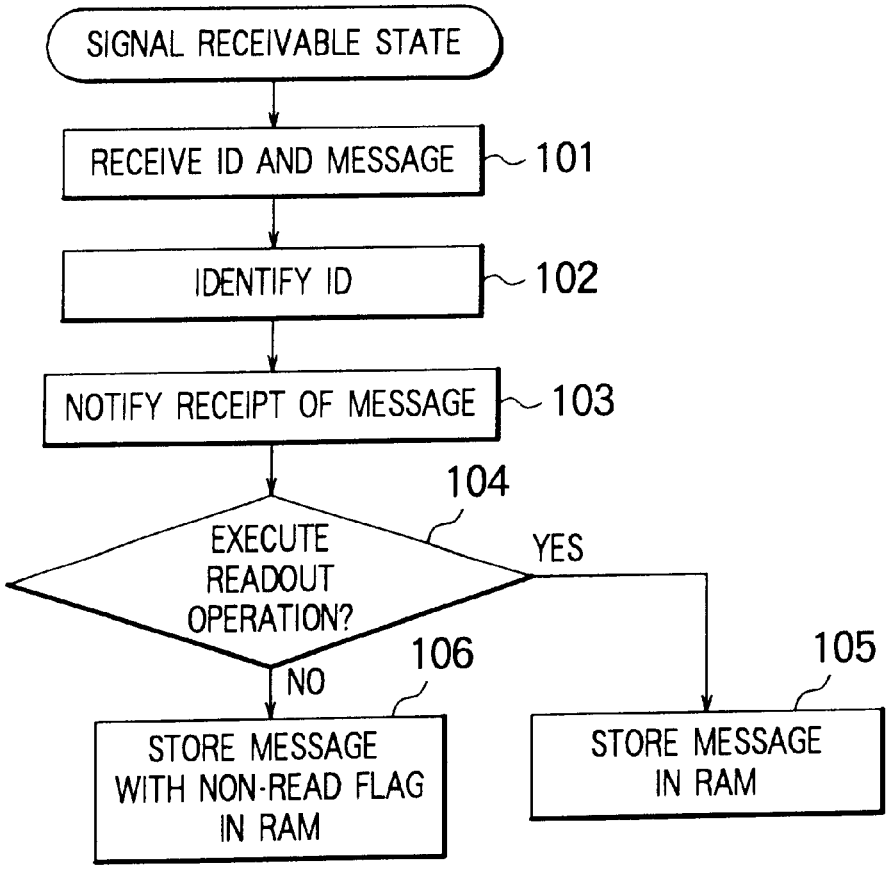
FIG. 2 is a flowchart showing an operation of the radio paging receiver of FIG. 1.

Turning to FIG. 2, the description will be directed to an operation for storing a received message. When an ID of the subject radio paging receiver and a following message are received in a paging call signal receivable state at a step 101, the control section 20 identifies the received ID at a step 102 and then notifies receipt of the message for a given time using a notifying means set by the user at a step 103.

When the user performs a readout operation using the readout switch 42 during notification, that is, when answer at a step 104 is positive, the operating section 40 produces a zeroth one of the command signals. Responsive to the zeroth one of the command signals, the control section 20 drives the LCD driver 51 to display the received message on the display unit 52. In this event, a combination of the control section 20 and the LCD driver 51 is referred to as a zeroth displaying arrangement.

Furthermore, the control section 20 stores, as a memorized message, the received message with other attributes (for example, receiving date and time) in the RAM 61 at a step 105. In this event, the control section 20 is referred to as a storing arrangement.

The user can desirably set directories corresponding to the respective ID's held by the subject radio paging receiver. The received message stored through the foregoing operation is managed under a directory set assigned to the subject ID.

On the other hand, when the user does not perform the readout operation during notification, that is, when answer at the step 104 is negative, the control section 20 stores, after notification, the message along with a particular flag or a non-read flag and the other attributes in the RAM 61 at a step 106. In other words, the control section 20 gives the non-read flag to the memorized message only when the readout switch 42 is not operated during the notification by the user. The non-read message, that is, the message with the non-read flag, is also managed under the directory set for the subject ID.

Figure 3:
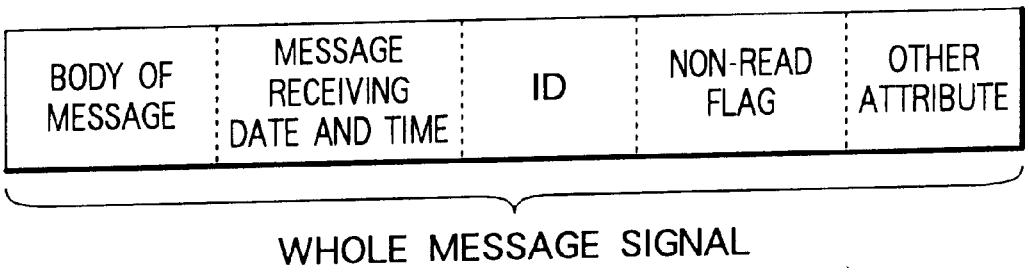
FIG. 3 is a diagram showing a storage format of a received message according to the preferred embodiment of the present invention.

A storage format of the received message will be explained with reference to FIG. 3. A message signal comprises the body of a message (part A), message receiving date and time (part B), an ID (part C), a non-read flag (part D) and other attributes (message sender, the number of times of receipts of the same message; part E).

Figure 4:
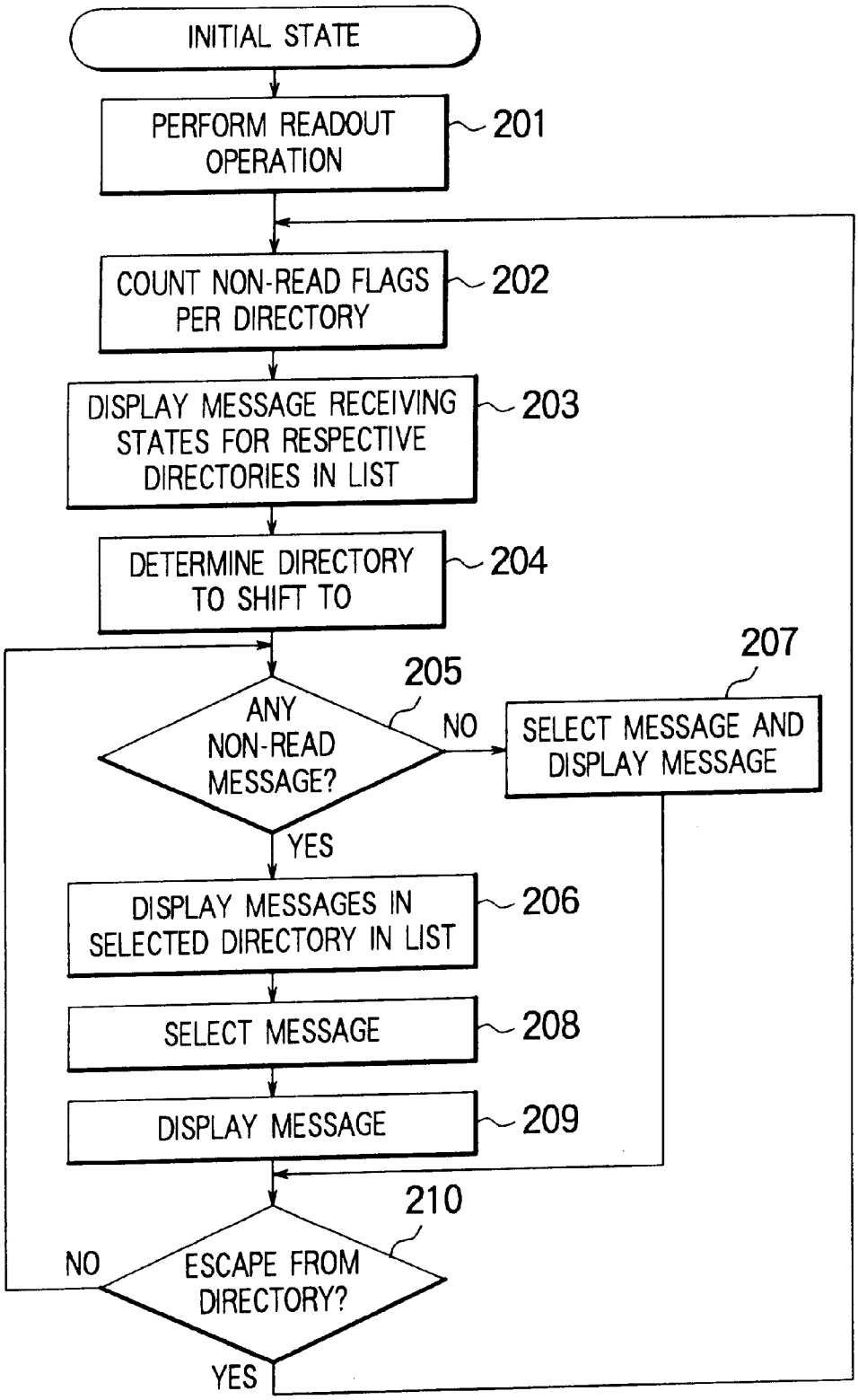
FIG. 4 is a flowchart showing an operation of the radio paging receiver of FIG. 1.

Turning to FIG. 4, the description will be made as regards an operation for reading out a non-read message when one or more non-read messages exist.

In an initial state, the control section 20 controls the display unit 52 to indicate presence of the non-read message. When the user pushes the readout switch 42 for reading out the non-read message at a step 201, the operating section 40 produces another one of the command signals. The other one will be called a second. Responsive to the second one of the command signals, the control section 20 counts the number of non-read flags in the RAM 61 per directory at a step 202. Then, at a step 203, the control section 20 controls the display unit 52 to display message receiving states for the respective directories on a list. In this event, a combination of the control section 20 and the display unit 52 is referred to as a second displaying arrangement.

Referring to FIGS. 5A to 5C, the description will be directed to examples of the list display carried out at the step 203. In the example shown in FIG. 5A, the display unit 52 displays presence or absence of the non-read message per directory. In the example shown in FIG. 5B, the display unit 52 displays the total message number and presence or absence of the non-read message per directory. In the example shown in FIG. 5C, the display unit 52 displays the total message number and the number of the non-read messages per directory. In FIGS. 5A to 5C, a portion corresponding to the directory C is surrounded by a rectangular frame. This represents that the directory C is being selected now. In practice, this portion is indicated by inversion display.

During the display carried out at the step 203, the user can select a desired directory using the scroll switch 43. When the user selects the directory and pushes the execution switch 45, the operating section 40 produces another one of the command signals. The other one will be called a third. Responsive to the third one of the command signals, the control section 20 makes a shift to the selected directory be automatically achieved at a step 204. In this event, the control circuit 20 serves as a selecting arrangement.

Then, if one or more non-read messages exist in the selected directory, that is, if answer at a step 205 is positive, the control section 20 further controls, at a step 206, the LCD driver 51 to make the display unit 52 carry out list display of a portion of the message, an attribute thereof and whether or not the message is a non-read message. In this event, a combination of the control section 20 and the LCD driver 51 will be referred to as a third displaying arrangement.

FIG. 6 shows an example of the list display carried out at the step 206. In this example, the display unit 52 displays, per message, a portion of the message, receiving date and time, whether or not the message is non-read, and a message sender. Other than the display example shown in FIG. 6, the display can be carried out by combining desired attributes.

On the other hand, if there are no non-read messages existing in the selected directory, that is, if answer at the step 205 is negative, the routine proceeds to a step 207 where selection and display of a message once read out can be carried out.

Referring back to a step 206, when the user selects the message using the scroll switch 43 (a step 208) and pushes the execution switch 45, the operating section 40 produces a first one of the command signals. Responsive to the first one of the command signals, the control section 20 controls the LCD driver 51 to display the selected message on the display unit 52 (a step 209). In this event, a combination of the control section 20 and the LCD driver 51 is referred to as a first displaying arrangement. Simultaneously, the control section 20 erases the non-read flag of the readout message. In this event, the control section 20 serves as an erasing arrangement.

After the user finishes confirmation of the message or a given operation so that the readout of the message is completed, the control section 20 asks the user to determine whether to escape from the directory at a step 210. As appreciated, when the user finishes confirmation of the message or a given operation so that the readout of the message is completed, the routine also proceeds to the step 210. On reading out the memorized message, the control section 20 will be referred as a reading out arrangement. On displaying the readout message, a combination of the control section 20 and the LCD driver 51 will be referred to as a fourth displaying arrangement.

If answer at the step 210 is positive, that is, if the user selects to escape from the current directory, the routine returns to the step 202. On the other hand, if answer at the step 210 is negative, that is, if the user selects to stay in the current directory, the routine returns to the step 205.

As described above, since the received message is assigned to the directory per ID thereof and stored, the remaining state of the non-read message can be displayed so that the user can confirm the non-read message per directory. Further, since the non-read message in the directory designated by the user can be displayed, the user can easily confirm the non-read message belonging to the desired ID.

While the present invention has thus far been described in conjunction with the single preferred embodiment thereof, it will readily be possible for those skilled in the art to put this invention into practice in various other manners. For example, the sender may be used as the attribute instead of the ID.

What is claimed is:

1. A radio paging receiver for being responsive to a radio signal carrying a message and an attribute of said message, comprising a display unit, command producing means for producing a plurality of command signals, and zeroth displaying means for displaying said message on said display unit in response to a zeroth one of said command signals, said radio paging receiver further comprising:

a memory including a plurality of directories, a selected one of which is assigned to said attribute;

storing means connected to said zeroth displaying means and said directories for storing said message as a memorized message into said selected one of the directories with reference to said attribute, said storing means giving a particular flag to said memorized message only when said zeroth displaying means is not operated;

first displaying means connected to said display unit, said command producing means, and said directories for displaying said memorized message on said display unit in response to a first one of said command signals;

erasing means connected to said directories and said first displaying means for erasing said particular flag from said memorized message when first displaying means is operated; and second displaying means connected to said display unit, said command producing means, and said directories and responsive to a second one of said command signals for displaying, on said display unit, information relating to the memorized message that is not given with said particular flag.

2. The radio paging receiver of claim 1, further comprising:

selecting means connected to said command producing means and said directories for selecting said selected one of the directories in response to a third one of said command signals; and third displaying means connected to said display unit and said selecting means for displaying, on said display unit, a list showing the memorized message that is memorized in said selected one of the directories and is not given with said particular flag.

3. The radio paging receiver of claim 2, further comprising:

reading out means connected to said command producing means, said directories, and said third displaying means and responsive to a fourth one of said command signals for reading out, from said selected one of the directories, the memorized message as a readout message that is not given with said particular flag; and fourth displaying means connected to said display unit and said reading out means for displaying said readout message on said display unit.

4. A radio paging receiver comprising a memory, a display unit, a receiving section, an operating section for inputting a command, and a control section, wherein said control section identifies an attribute of each of messages when received at said receiving section, and stores each of said messages along with a non-read flag in a directory in said memory, said directory predetermined corresponding to each of said attributes, wherein, when one of the messages is readout from said memory and displayed by said display unit according to a command from said operating section, said control section erases the non-read flag corresponding to said displayed message, and wherein, according to a command from said operating section, said control section controls said display unit to display, per directory, a remaining state of each of the messages which are stored in said directories and whose non-read flags are not erased.

5. The radio paging receiver of claim 4, wherein, according to a command from said operating section, said control section selects one of said directories, and controls said display unit to display a list showing the messages which are stored in said selected directory and whose non-read flags are not erased.

6. The radio paging receiver of claim 5, wherein, according to a command from said operating section, said control section reads out one of said messages shown on said list from said storage means while said display unit displays said list, and controls said display unit to display said readout message.

7. The radio paging receiver of claim 6, wherein, after said display unit displays said readout message, said control section, responsive to a given command from said operating section, accepts a request for readout and display of the message which is stored in the same directory as said readout message and whose non-read flag is not erased.

8. A method of being responsive to a radio signal carrying a message and an attribute of said message, comprising the steps of producing a plurality of command signals and displaying said message on a display unit in response to a zeroth one of said command signals, said method further comprising the steps of:

maintaining a plurality of directories, a selected one of which is assigned to said attribute;

storing said message as a memorized message into a selected one of the plurality of directories with reference to said attribute;

giving a particular flag to said memorized message in response to absence of said zeroth one of the command signals;

displaying said memorized message on said display unit in response to a first one of said command signals;

erasing said particular flag from said memorized message in response to presence of said first one of the command signals; and being responsive to a second one of said command signals and displaying, on said display unit, information relating to the memorized message that is not given with said particular flag.

9. The method of claim 8, further comprising the steps of:

selecting said selected one of the directories in response to a third one of said command signals; and displaying, on said display unit, a list showing the memorized message that is memorized in said selected one of the directories and is not given with said particular flag.

10. The method of claim 9, further comprising the steps of:

being responsive to a fourth one of said command signals and reading out, from said selected one of the directories, the memorized message as a readout message that is not given with said particular flag; and displaying said readout message on said display unit.

* * * * *